US008640625B1

(12) United States Patent
Wong et al.

(10) Patent No.: US 8,640,625 B1
(45) Date of Patent: Feb. 4, 2014

(54) KINETIC ENERGY TRAINING PROJECTILE

(75) Inventors: Brian Wong, Hamburg, NJ (US); Andrew Gowarty, East Stroudsburg, PA (US); Francis Donlon, Blairstown, NJ (US); Francis Renner, Stroudsburg, PA (US); Robert Sayer, Sparta, NJ (US); Carlton Adam, Newton, NJ (US); Daniel Vo, Landing, NJ (US); John Dineen, Wharton, NJ (US); Anthony Farina, Hackettstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/211,624

(22) Filed: Aug. 17, 2011

(51) Int. Cl.
*F42B 14/06* (2006.01)
*F42B 8/14* (2006.01)

(52) U.S. Cl.
USPC ..... 102/523; 102/529; 102/520; 102/444

(58) Field of Classification Search
USPC ..... 102/520, 521, 522, 523, 529, 444, 446, 102/447, 498
See application file for complete search history.

(56) References Cited

U.S. PATENT DOCUMENTS

| | | | | |
|---|---|---|---|---|
| 5,498,160 | A * | 3/1996 | Farina et al. | 434/12 |
| 5,501,155 | A * | 3/1996 | Hollis et al. | 102/529 |
| 5,874,691 | A * | 2/1999 | Manole et al. | 102/529 |
| 6,123,289 | A * | 9/2000 | Manole et al. | 244/3.24 |
| 6,626,113 | B1 * | 9/2003 | Gilman et al. | 102/444 |
| 7,197,984 | B2 * | 4/2007 | Eches | 102/521 |
| 2005/0188891 | A1 * | 9/2005 | Heitmann et al. | 102/523 |

* cited by examiner

*Primary Examiner* — James Bergin
(74) *Attorney, Agent, or Firm* — Michael C. Sachs

(57) ABSTRACT

A kinetic energy training cartridge simulates the performance, weight, length, and external geometry of a tactical cartridge. The training cartridge includes a cartridge case and a projectile that is secured to cartridge case by means of a sabot. The sabot includes a rearward extension that encapsulates part of the projectile, to add weight and to increase a length to diameter ratio of the projectile, so as to decrease an intrusion volume of the projectile within the cartridge case. In a preferred embodiment, the length to diameter ratio of the projectile is at least 15.

2 Claims, 4 Drawing Sheets

KINETIC ENERGY TRAINING PROJECTILE

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to projectiles, and it particularly relates to a low cost, long rod training projectile, having the look and feel of a service projectile.

BACKGROUND OF THE INVENTION

The Army has a need for realistic, restricted maximum range, low cost training ammunition, also referred to herein as projectile. Training projectiles are procured in quantities that greatly exceed the service projectiles, and they are expended during training at a high rate. Typically, most of the tank training ammunition that is produced in a year is used in training exercises. Although costs vary due to materials used and production rates, the typical cost of a service projectile might range between 1.5 and 14 times that of a training projectile. For this reason, it is necessary that the training projectiles have a very low acquisition cost.

Existing training ammunitions for tanks and other direct fire systems suffer from shortcomings in many areas of physical realism, flight performance, and cost. More specifically, in the case of a 105 mm tank training ammunition, the conventional training projectiles that are used to simulate kinetic energy service rounds have a much different physical profile than the service rounds. This training round cartridge, the M724A1 is much shorter than the corresponding M900 service round. Such difference can cause the soldiers to have a significantly reduced training effectiveness. In addition, since the M724A1 projectile is gyroscopically (spin) stabilized and the service projectile is statically (fin) stabilized, they have significantly different flight characteristics.

In the case of the 120 mm tank training ammunition, the conventional M865PIP training round is significantly shorter than the corresponding M829A2 service round. As a result, such a difference could provide the soldiers with an adverse training environment, both from length and cartridge center of gravity concerns.

What is therefore needed is a realistic, restricted maximum range, low cost training projectile. Prior to the advent of the present invention, the need for such a training projectile has heretofore remained unsatisfied.

SUMMARY OF THE INVENTION

The present invention satisfies this need, and describes a realistic, restricted maximum range, low cost training projectile. This training projectile meets several basic requirements, some of which are described herein.

The projectile has a generally similar look and feel as the service projectile, also referred to as a tactical or war projectile. The projectile allows the soldiers to experience the realistic handling of the service projectile during training exercises. The overall projectile weight and its center of gravity, and importantly its length, are as close to the service projectile as possible. Failure to meet this requirement could result in negative training. For example, with a training round cartridge that is shorter than a service round cartridge, the soldier might become used to swinging around the shorter cartridge inside the tank turret during the loading operation. Then, when in time of war, the soldier attempts to swing around and load the service ammunition, he is at risk of damaging the nose tip and rendering the ammunition inoperable.

The present projectile must also perform in flight as closely as possible to the service ammunition, while concurrently having a limited maximum range. The flight performance must match the service projectile so that the soldiers become used to the time of flight to the target, the arc of the trajectory and the crosswind performance of a projectile that is as close as possible to what they will experience with the service round, so that the aiming techniques that they learn will transfer effectively to the use of the service round. The maximum range of the training projectile must be limited so that training may be conducted on training ranges without fear of the projectile exceeding and leaving the training range.

The foregoing and additional features and advantages of the present invention are realized by a flight projectile that generally includes a long rod body and a conical nose. The projectile is stabilized in flight by a conical flare affixed to its aft end, which provides lift for static stability, drag for reduced maximum range, and which, in some embodiments has angled slots in order to induce spin for improved target impact dispersion (TID) performance.

The body of the projectile may, for purposes of center of gravity management or ballasting, be made of differing materials, and may optionally be solid, hollow, or a combination of a solid section(s) and a hollow section(s). Upon assembly into a sabot and a cartridge, the present projectile is designed to have an overall length that approximately equals that of the service cartridge, and a center of gravity that is quite close to that of the service cartridge.

Due to the balanced aerodynamic design of the length to diameter (lid) ratio, the stability margin, spin rate, and drag, the ballistic flight of the projectile, including its arc of trajectory, crosswind performance, target impact dispersion (TID) performance, and limited maximum range, will allow for training that is as close as possible to the service ammunition. This will provide realistic training for the soldiers as they prepare to use the service ammunition in the time of war.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
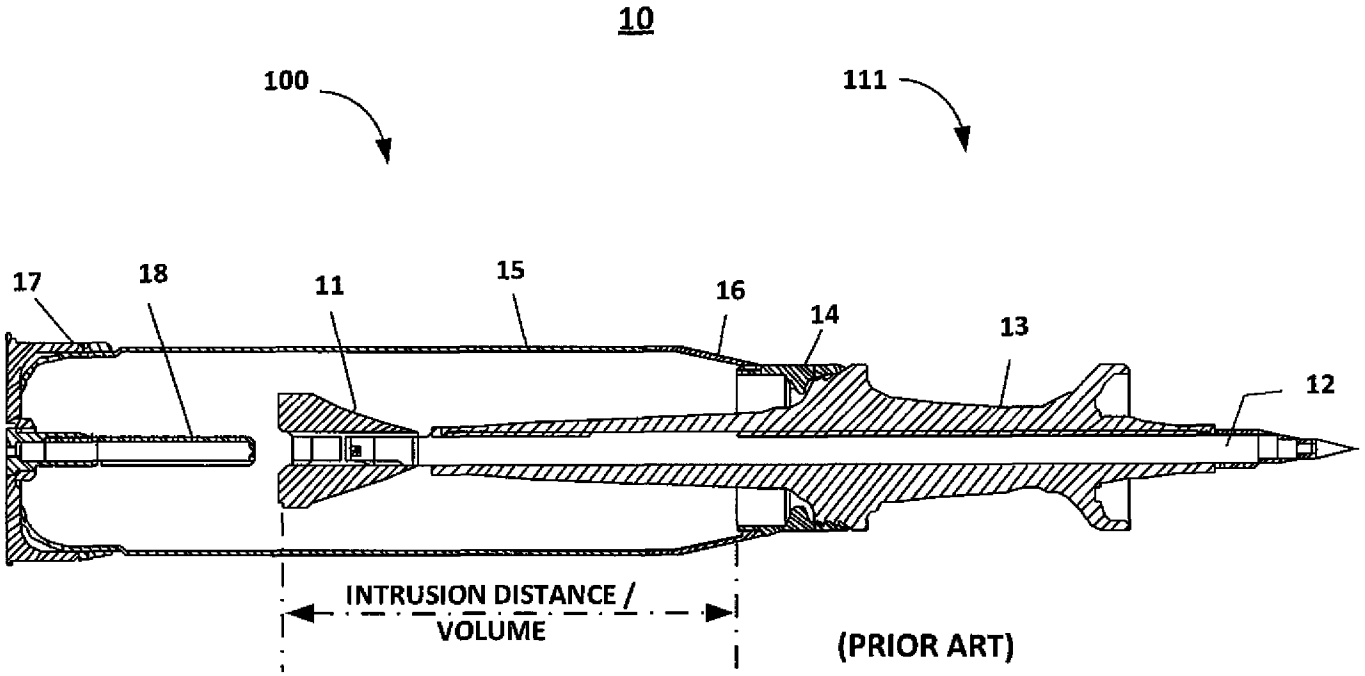
(PRIOR ART) FIG. 1
FIG. 1 is a cross-sectional, side view of a conventional kinetic energy tactical cartridge.

FIG. 1 is a cut-away profile view of a conventional kinetic energy tactical cartridge 10, such as the M900 kinetic energy tactical cartridge (or service round). FIG. 1 provides an emphasis on the outer geometry of the cartridge 10 and allows comparison with the length and profile of the training cartridge 20 of FIG. 2 and the long range training projectiles 30 and 40 of FIGS. 3 and 4, respectively.

The kinetic energy tactical cartridge 10 is generally comprised of a cartridge assembly 100 and a projectile assembly 111. The projectile assembly 111 includes a plurality of fins 11, a projectile (or projectile rod) 12, a sabot 13, and an obturator 14. The cartridge assembly 100 includes a cartridge case 15, a case adapter 16, a case base and a seal assembly 17, and a primer 18. The tactical cartridge 10 incorporates external features that are required by the ordnance's operational requirements description for a future kinetic energy tank training round.

Figure 2:
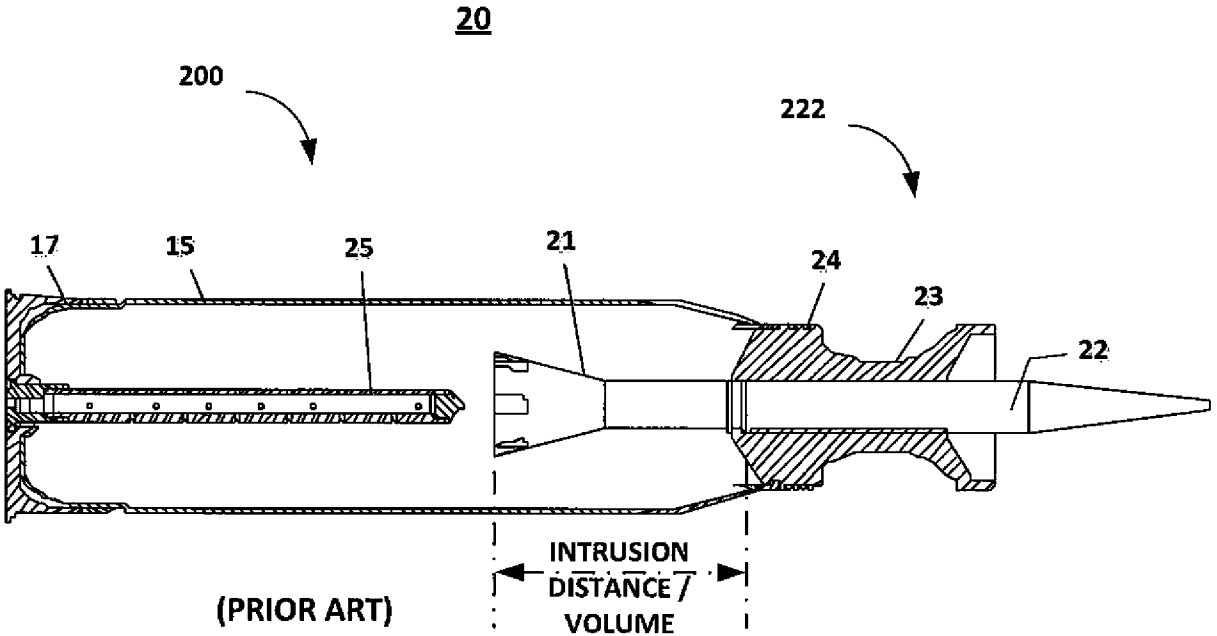
(PRIOR ART) FIG. 2
FIG. 2 is a cross-sectional, side view of another conventional kinetic energy training cartridge.

FIG. 2 is a cut-away view of another conventional training cartridge 20 for use as substitutes for tank kinetic energy tactical cartridges. FIG. 2 provides an emphasis on the outer geometry of the cartridge and allows comparison for length and profile with the kinetic energy tactical cartridge 10 of FIG. 1.

The training cartridge 20 is generally comprised of a cartridge assembly 200 and a projectile assembly 222. The projectile assembly 222 includes a high drag cone 21, a projectile (or projectile rod) 22, a sabot 23, and an obturator 24. The cartridge assembly 200 includes a cartridge case 15, a case adapter 16, a case base, a seal assembly 17, and a primer 25. FIG. 2 illustrates that the kinetic energy trainer or cartridge 20 does not meet the external features, including the dimensions, required by the ordnance's operational requirements description for a future kinetic energy tank training rounds needed (as illustrated in FIG. 1).

Figure 3:
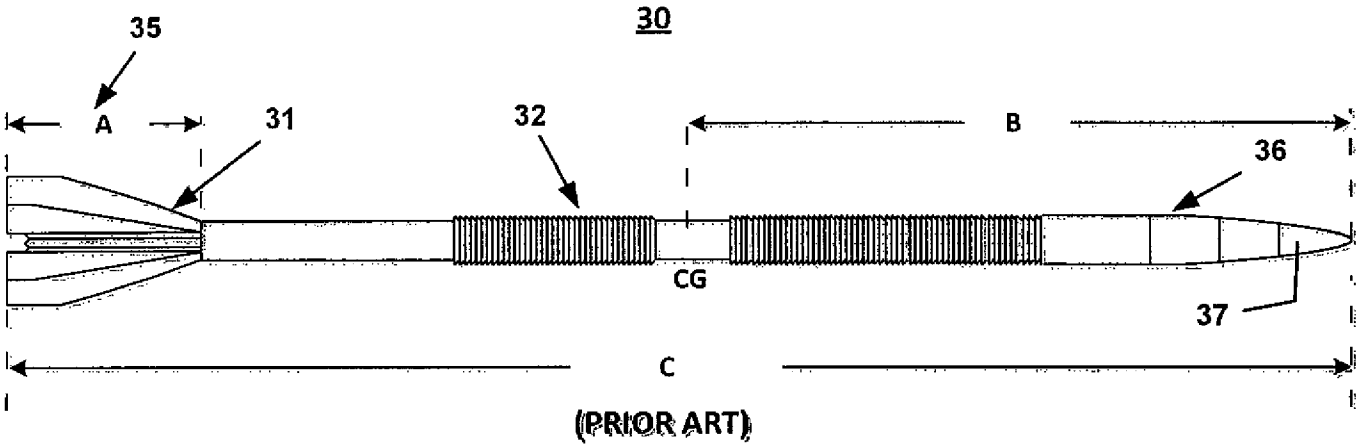
(PRIOR ART) FIG. 3
FIG. 3 is a side view of a conventional kinetic energy tactical projectile, for use, as an example in the tactical cartridge M900.
Figure 4:
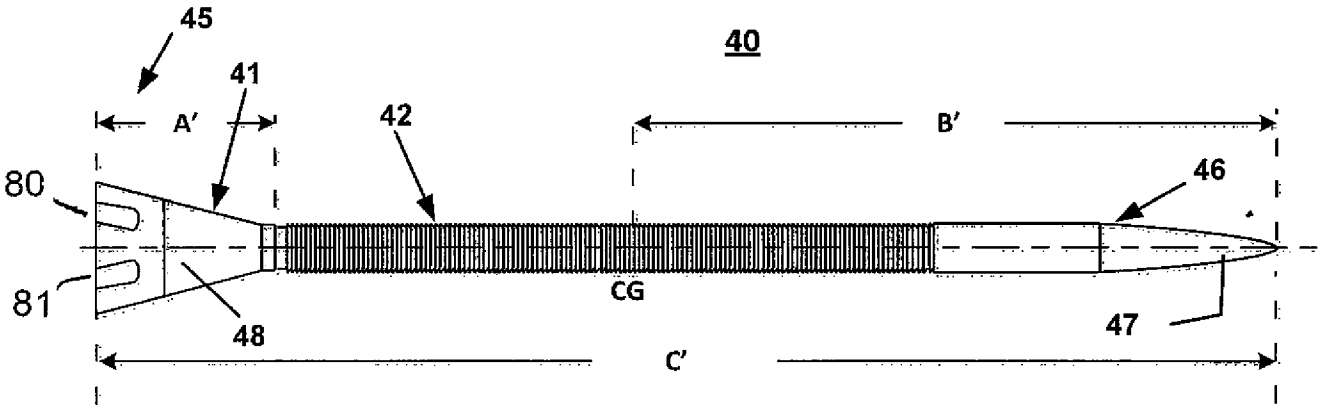
FIG. 4 is a side view of a kinetic energy training projectile according to an embodiment of the present invention, compared to the tactical projectile of FIG. 3.

FIG. 3 illustrates a conventional kinetic energy tactical projectile 30, for use, as an example in the tactical cartridge 10 (e.g., M900) of FIG. 1. FIG. 4 illustrates a long range training projectile 40 according to a preferred embodiment of the present invention. FIGS. 3 and 4 provide an emphasis on the outer geometries of the projectiles 30 and 40, and allow for the comparison of their respective lengths and profiles.

The tactical projectile 30 (or projectile 12, FIG. 1) of FIG. 3 generally includes an aft section 35 that is equipped with a plurality of fins 31, a projectile rod 32, and a forward section 36 that comprises a nose 37. The training projectile 40 of FIG. 4 generally includes an aft section 45 that is equipped with a high drag aft conical section 41, a projectile rod 42, and a forward section 46 that comprises a nose 47.

Figure 5:
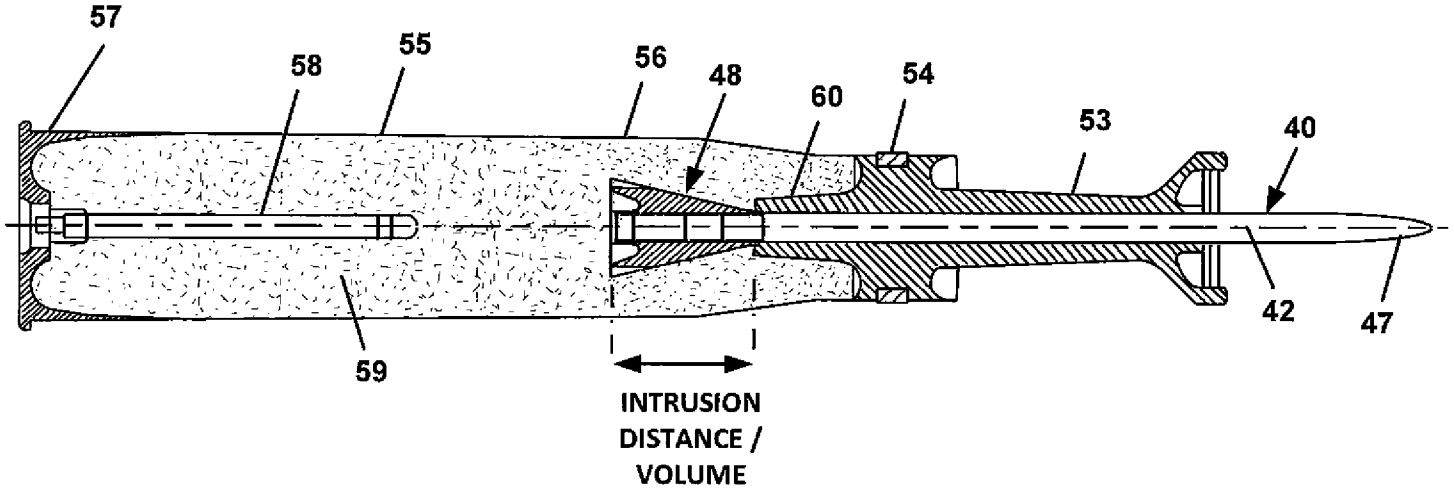
FIG. 5 is a cross-sectional, side view of a training cartridge, incorporating the training projectile of FIG. 4.

The training projectile 40 incorporates features that improve the performance of a kinetic energy training cartridge 50 (FIG. 5). Some of these features are presented below.

The weight and length of the overall training projectile 40 simulate those of the actual tactical projectile 30 of FIG. 3.

The external geometry of the overall training projectile 40 simulates or is almost identical to that of the tactical projectile 30 of FIG. 3.

The design results in accuracy and precision of the training cartridge 50, which incorporates the projectile 40, meet the Army's current target impact dispersion requirements.

The conical section 41 allows for a shorter projectile 40 to use the same or similar cone design as the M865 cartridge 30 of FIG. 3, in order to achieve the 8000-meter range should a higher velocity be required on the training cartridge 50 with high velocity rounds.

Utilizing a kinetic energy aft conical section 41 allows for cost savings and improved flight stability over, for example, conventional 120 mm tank training rounds.

The training projectile 40, 50 of FIGS. 4, 5, respectively, features a flight projectile with a long rod body 42, generally but not exclusively with a length to diameter (lid) ratio of 15 or greater, a conical nose 47 which is typically 14 degrees of half angle, but in practice can range from 1 degree to 45 degrees (blunt face). Alternatively, the nose 47 may be ogive shaped and may end in a point, a flat, or a nearly flat tip (meplat). The nose-body (47, 42) assembly is stabilized in flight by a conical flare 48 that forms part of the aft conical section 41, which provides lift for static stability, drag for reduced maximum range, and which, in another embodiment, has angled slots 80, 81, e.g., that may vary in cant angle typically from 2 degrees to 20 degrees. The cant angle may be set to any angle that is suitable for proper flight performance, in order to induce spin for improved target impact dispersion (TID) performance.

In comparison, the aft section 35 of the tactical projectile 30 (FIG. 3) has generally a similar length, A, as the length, A', of the aft section 45 of the training projectile 40 (FIG. 4). More specifically, the present embodiment illustrates the length of the aft section 35 to be approximately 4.26 inches, with the length of the aft section 45 being approximately 4 inches.

The projectile 30 has a center of gravity, CG, that is located at a distance B from the tip of the nose 37. In comparison, the projectile 40 has a center of gravity, CG', that is located at a distance B' from the tip of the nose 37. More specifically, the present embodiment illustrates the distance B of the center of gravity of the projectile 30 as being approximately 13.74 inches, while the distance B' of the center of gravity of the projectile 40 as being approximately 13.27 inches.

The body or projectile rod 42 of the training projectile 40 may, for purposes of center of gravity management or ballasting, be made of differing materials. Alternatively, the internal volume of the projectile rod 42 may be solid, hollow, or partly solid. In certain embodiments, depending on the performance requirements and other requirements, the conical flare 48, may be a fin assembly of two or more blades. The conical flare 48 will typically have a half angle from approximately 10 degrees to 30 degrees; however, in practice, it may be designed with half angles ranging from approximately 1 degree to 45 degrees (a blunt flare).

While the overall length, C, of the illustrated tactical projectile 30 is approximately 27.98 inches, the corresponding training projectile 40 has an overall length, C', is approximately 22.94 inches.

With further reference to FIG. 5, it illustrates a training cartridge 50 that incorporates the training projectile 40 of FIG. 4, according to the teaching of the present invention. Preferably, the training cartridge 50 includes the following components: a cartridge case 55, a case adapter 56 that encapsulates propellant 59, a case base and seal 57, and a primer 58, that are similar to corresponding components of the conventional training cartridge 20 (M865) of FIG. 2. This similarity minimizes the impact on production cost and time. In addition, the conical flare 48 may be used in place of the fins 31, should a high drag projectile be needed.

When the projectile 40 is assembled into its sabot 53 and case adapter 56, it is designed to have an overall length approximately equal to the corresponding service cartridge, and a center of gravity very close to that of the service cartridge. Due to its carefully balanced aerodynamic design including the 11d ratio, stability margin, spin rate and drag, its ballistic flight, including the arc of trajectory, crosswind performance, TID, and limited maximum range will allow for training that is as close as possible to the use of the service ammunition. This will provide realistic training for the soldiers as they prepare to use the service ammunition.

The overall training cartridge 50 may make use of one or more features pertinent to the present invention. These may include the use of various propellants, such as LOVA, M14, M1, or other suitable propellants. The cartridge case 55 may be made of brass, steel, aluminum, any combustible, or any other suitable material, such that the performance and safety requirements are achieved. A tracer, which is typically embedded in the conical flare 48, may be made of various chemical mixtures or may use electronic devices such as LCDs (liquid crystal display devices) or other means to provide visibility of the flight path to the tank crew, though not all embodiments may employ this feature.

A variety of available or suitable clip designs that hold the cartridge case base 57 to the cartridge adapter 56, may be used. The nose 47, body projectile rod 42, and conical flare 48 of the projectile 40 may be made of steel, aluminum, or any other suitable metal or material such as plastic, or combination thereof, which will provide for the correct mechanical and flight performance. Various fabrication techniques such as, but not limited to extrusion, machining from bar stock, casting, and molding may be used for any of the components of the training cartridge 50. These components may also be of new manufacture, or to keep cost low, may be of recycled components used "as-is" or with modification from demilitarized ammunition items. The design of the training projectile 40 is not limited by size, it may be adapted for use in weapons typically from 25 mm to 140 mm, but may be used in weapons of any caliber.

The weight of the training cartridge 50 has been increased from the conventional training cartridge 20. This is achieved by a longer and heavier sabot 53, a heavier case base 56, or a case base and seal assembly 57. Known or available sabots can be used provided they satisfy the weight and length requirements. An exemplary known sabot 53 comprises three petals that have standard kinetic energy threads and/or buttress grooves that support the projectile rod 42 upon gun launch. The sabot petals are discarded after gun launch, and come apart in the air stream, allowing the in-flight projectile (i.e., projectile rod 42 and the aft section 41) to continue down-range toward the target. The sabot 53 is rendered heavier by adding a rear extension 60 that extends rearwardly, to a closer proximity to the conical flare 48, thus providing added stability and decreasing the intrusion distance or volume.

Due to the fact that the projectile 40 is partially encapsulated in the sabot 53, the projectile rod 42 can now be shorter than, and have a smaller outer diameter than the training projectile 22 of the training cartridge 20 of FIG. 2. This provides a low mass in-flight projectile, i.e., less than 3 lbs, that has enough momentum to fly accurately to the 3000- to 4000-meter targets, but will not fly past the 8000-meter limit at a 10 degree gun elevation due to lack of momentum.

The shorter projectile rod 42 will have a significantly greater velocity than the projectile 22 of the training cartridge 20 of FIG. 2, for the same type of propellant (i.e., M14) and charge weight of propellant if an aluminum sabot 53 were used. This allows less M14 propellant to be used in the training cartridge 50, reducing the overall cost of production. If a steel sabot 53 were used, then the training cartridge 40 will have a similar amount of propellant to the training cartridge 20 of FIG. 2, but cost saving is achieved by using a steel sabot instead of an aluminum sabot 53.

Additionally, because the in-flight projectile rod 52 is partially encapsulated in the sabot 53, it will not be subject to differential pressures (-dp), and thus will not have bending problems that most kinetic energy projectile rods have which cause accuracy problems in-flight.

The present training cartridge 50 of FIG. 5 achieves a decreased intrusion distance or volume as compared to the cartridges 10 and 20 of FIGS. 1 and 2, respectively. As the fins 11 or flare 21 extend rearward toward the primer 18 or 25, it displaces the propellant inside the cartridge. Such displacement constitutes an undesirable feature because it minimizes the space available for the propellant and thus a higher energetic propellant needs to be used in order to compensate for the displaced volume and to obtain the same or similar performance. The higher energetic propellants are generally costlier than the corresponding lower energetic propellants.

With reference to FIG. 5, the conical flare 48 is remotely located relative to the primer 58, as compared with the fins 11 or flare 21 relative to the primer 18 or 25. As a result, the intrusion distance/volume of the cartridge 50 is more economical than the cartridges 10 and 20 because it requires a less energetic propellant to achieve the same or similar performance as the tactical projectile. Decreased intrusion distance or volume is achieved because the flared stabilizer or conical flare 48 provides static stability without the need to extend rearward toward the primer 58.

It should be understood that other modifications may be made to the present design without departing from the spirit and scope of the invention.

What is claimed is:

1. A kinetic energy training cartridge that simulates the performance, weight, length, and external geometry of a tactical cartridge, comprising:

a cartridge case having a defined original length to diameter ratio;

a projectile that is secured to the cartridge case by means of a sabot and wherein said projectile has a defined original intrusion volume into the said cartridge case; and wherein the sabot includes a rearward extension that encapsulates part of the projectile, to add weight to the cartridge case and to increase the length to diameter ratio of the cartridge case, and so as to also decrease the original intrusion volume of the projectile within the cartridge case, and wherein the projectile further includes a stabilizer which includes angled slots that vary in cant angle from approximately 2 degrees to 20 degrees, in order to induce spin for improved target impact dispersion performance.

2. The kinetic energy training cartridge of claim 1, wherein the length to diameter ratio of the projectile is at least 15.

* * * * *